US005605310A

United States Patent [19]

Jungkind

[11] Patent Number: 5,605,310

[45] Date of Patent: Feb. 25, 1997

[54] SUPPORTING DEVICE FOR A GOLFBAG

[75] Inventor: Roland Jungkind, Garmisch-Partenkirchen, Germany

[73] Assignee: MS-Trade Handels-GmbH, Germany

[21] Appl. No.: 289,820

[22] Filed: Aug. 12, 1994

[30] Foreign Application Priority Data

Aug. 13, 1993 [DE] Germany ..... 43 27 289.4

[51] Int. Cl.[6] ..... A63B 55/00

[52] U.S. Cl. ..... 248/96; 248/688; 206/315.7

[58] Field of Search ..... 248/96, 688, 351, 248/434, 435; 206/315.7, 315.3, 315.4

[56] References Cited

U.S. PATENT DOCUMENTS

| | | | |
|---|---|---|---|
| 1,693,889 | 12/1928 | Dick | 248/96 |
| 1,744,557 | 1/1930 | Kuntz . | |
| 1,865,689 | 7/1932 | Hansen et al. | 248/96 |
| 1,890,362 | 12/1932 | Bellow . | |
| 1,954,413 | 4/1934 | Hunter | 206/315.7 X |
| 2,016,967 | 10/1935 | Komers | 248/96 |
| 2,661,174 | 12/1953 | Sands | 248/96 |
| 4,226,389 | 10/1980 | Neth . | |
| 4,778,136 | 10/1988 | Reimers | 206/315.7 X |
| 4,949,844 | 8/1990 | Yang | 248/96 X |

*Primary Examiner*—Karen J. Chotkowski
*Attorney, Agent, or Firm*—Austin R. Miller

[57] ABSTRACT

In the case of a device for supporting a container, in particular a golf bag, the supporting device is designed integrally with the container in that an annular retaining means (2) with supporting legs (4) articulated thereon is provided, the retaining means (2) forming part of the container (1).

10 Claims, 1 Drawing Sheet

SUPPORTING DEVICE FOR A GOLFBAG

Figures 1, 2, 3, 4, 5:
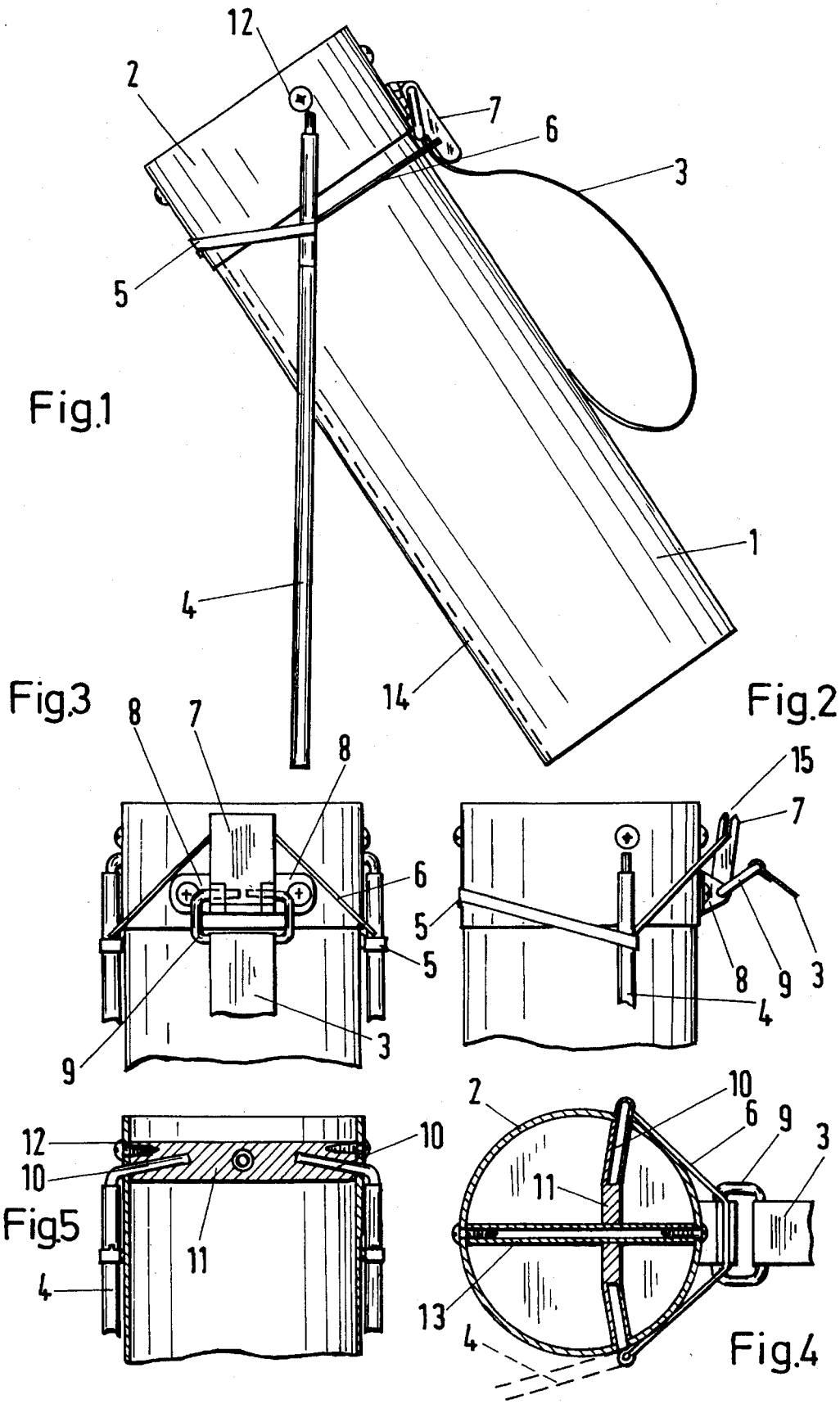

The invention relates to a supporting device according to the preamble of claim 1.

A device of this type is disclosed in U.S. Pat. No. 1,890,362, the supporting legs being provided with a lever which has to be pushed downwards in order to pivot the supporting legs away. In order that the supporting legs do not jut out in an uncontrolled manner during pivoting, a band is laid loosely around the circumference of the golf bag.

The object of the invention is to design a supporting device of the type specified in the introduction such that it has improved handling.

This object is achieved by the features in the characterizing part of claim 1.

Advantageous developments of the invention are specified in the further claims.

An exemplary embodiment of the invention is illustrated in more detail hereinbelow with reference to the drawing, in which:

FIG. 1 shows, in a side view, the device in conjunction with a golf bag in the supporting position, FIG. 2 shows, in the same view, the upper part of the golf bag with supporting legs butting against it, FIG. 3 shows a view of FIG. 2, offset through 90°, FIG. 4 shows, in a plan view of the container, a cross-section approximately in the plane of the articulation points, and FIG. 5 shows a longitudinal section through the articulation points.

In FIG. 1, 1 designates a schematically represented golf bag which exhibits, at the upper end, a reinforcing sleeve 2 on which the carrying strap 3 is fastened by one end. Said reinforcing sleeve 2 forms a retaining means for supporting legs 4 which are articulated in an off-center manner on both sides. In one circumferential direction of the reinforcing sleeve or of the retaining means 2, the supporting legs 4 are acted upon by a rubber band 5 which is fastened in the vicinity of the articulation point on the supporting legs 4 and is laid around the annular retaining means 2. Fastened level with the rubber band 5, on the supporting legs 4, is a tension cable 6 which is guided through one end of a link 7 and whose other end is articulated on the annular retaining means 2. In that position of the link 7 in which the latter is pivoted downwards, the supporting legs 4 are released to such an extent that they can be pivoted by the rubber band 5 into the supporting position in which they are located obliquely with respect to the longitudinal axis of the golf bag 1, as shown in FIG. 1. By pivoting the link 7 upwards, the supporting legs 4 are pivoted via the tension cable 6, with bracing of the rubber band 5, into the abutment position, as shown in FIG. 2, in which they butt, approximately parallel with respect to the axis of the golf bag, against the circumference of the latter.

The arrangement of the fastening point of the tension cable 6 on the supporting legs 4 and articulation point of the link 7 is designed such that a snap-action mechanism is obtained, the link 7 being pivoted via a dead center.

In the case of the exemplary embodiment represented, two approximately L-shaped fitting parts 8, on which the link 7 is articulated, are fixedly screwed on the circumference of the annular retaining means 2. The articulation pin is formed by the two inwardly bent ends of an approximately annular hoop 9 on which the carrying strap 3 is fastened. As shown in FIG. 1, the fastening point of the carrying strap 3, in the supporting position of the device, is located beneath the link 7, with the result that, by lifting the golf bag by means of the carrying strap 3, the link 7, as a result of the weight of the bag, is pivoted upwards via the dead center into the position which is represented in FIG. 2 and in which the supporting legs 4 are laid against the circumference of the bag.

Upon lifting the bag up by means of the carrying strap 3, the hoop 9 comes to butt against the underside of the link, as a result of which the upwards pivoting movement of the link 7 is promoted. Instead of the hoop 9, provision may also be made for a reinforcement of the strap end in order to facilitate the upwards pivoting of the link 7.

The articulation of the supporting legs 4 on the annular retaining means 2 can be formed in various ways, for example by bearing points for the upper ends of the supporting legs 4 being formed in the annular retaining means 2. Preferably, the supporting legs 4 are mounted pivotably, by angled-off upper ends 10, in a bearing web 11 which, in the case of the exemplary embodiment represented, is inserted in an off-center manner into the annular retaining means 2, on the side of the link 7, and is fastened thereon by means of screws 12. The angled-off upper ends of the supporting legs 4 are plugged into blind bores of said bearing web 11 which predetermine the plug-in depth of the ends 10, and they are held in the plugged-in position by the rubber band 5. The bearing web 11 is expediently of rectangular cross-section.

In order, for a stable supporting position, to obtain greater mutual spacing at the lower ends of the supporting legs 4 than at the upper articulation points, the angled-off upper ends 10 of the supporting legs 4 run obliquely with respect to the diameter line, represented by a reinforcement 13, of the annular retaining means 2, shown in FIG. 4. The opposite ends of the web 11 are of a correspondingly angled-off design for this purpose. At the same time, the ends 10 run obliquely with respect to the longitudinal axis of the bag, as shown in FIG. 5. The ends 10 are angled off by an angle of greater than 90° with respect to the supporting legs 4 and are plugged into obliquely upwardly running blind bores in the web 11. If, in the case of this arrangement, the supporting legs 4 are pivoted out of the abutment position in FIG. 4, in which they butt against the bag outer circumference predetermined by the annular retaining means 2, into the supporting position which is shown by broken lines in FIG. 4, then the lower ends of the supporting legs 4 are at an essentially greater mutual spacing than is predetermined by the diameter of the annular retaining means 2.

The third bearing point in the supporting position is formed by the lower border of the bag 1, as long as the latter is of a sufficiently rigid design. In the case of a flexible material of the bag, a reinforcing strip 14 running along the circumference parallel to the container axis can be inserted into the bag, as shown in FIG. 1 by broken lines. Said reinforcing strip 14 is fastened on the annular retaining means 2 by the upper end.

In order to reinforce the annular form of the retaining means 2, in the case of a heavy bag, with respect to the forces acting on the circumference by way of the link 7, the reinforcing strut 13, represented in FIG. 4, is inserted perpendicularly with respect to the articulation axis of the link 7, it being possible to dispense wish the same in the case of a correspondingly rigid configuration of the retaining means 2.

The described device with retaining means 2 and supporting legs 4 articulated thereon as well as the link 7 which is articulated thereon may also be advantageously used for containers other than golf bags. For example, a flexible sack can be fastened, as container, on the retaining means 2, in this case the reinforcing strut 14 being provided. The retaining means 2 may also be in a form other than circular, for example rectangular.

Since a web 11 is present in golf bags in any case, said web may be used subsequently for the articulation of the supporting legs 4 in the described form.

Instead of the rubber band 5, springs my also be fastened on the retaining means 2 in order to act on the supporting legs 4.

The tension cable 6 is preferably inserted into a groove 15, as shown in FIG. 2, in order that the tension cable 6 can be released without difficulty from the link 7 and in order that the supporting legs 4 can be drawn out of the bearing web 11. The removed supporting legs may then be placed into the bag 1.

In the region of the fastening point of the tension cable 6, there may be fitted, on the supporting legs 4, a disk or a lever on which the tension cable 6 is fastened in order to achieve a favorable force-application line of the tension cable 6.

I claim:

1. A supporting device for a golf bag comprising:

a rigid retaining means encircling an upper portion of said golf bag, a plurality of support legs, pivotably attached to said golf bag, at least one elastic element connected to said support legs capable of pivoting said support legs away from said golf bag, a tension cable connected to said support legs, a pivotable link attached to said golf bag and connected to said tension cable, whereby said link can pivot from a position in which said support legs are secured in abutment to said golf bag to another position in which said support legs are released, wherein said link is attached to said retaining means by an approximately annular hoop, onto which a carrying strap is fastened, such that, when said carrying strap is lifted, said hoop releases said link.

2. The device of claim 1, wherein said supporting legs exhibit inwardly angled pins which are plugged into blind bores of a bearing web fastened in said retaining means.

3. The device of claim 1, wherein a supporting strut is fastened across said retaining means in line with said carrying strap.

4. The device of claim 1, wherein a reinforcing strut is fastened on said retaining means running along a wall of said golf bag approximately perpendicular to said retaining means.

5. The device of claims 1 and 7, wherein said elastic element comprises a rubber band.

6. A supporting device for a golf bag comprising:

a plurality of support legs pivotably attached to said golf bag, said support legs being capable of pivoting from a stored position in abutment of said golf bag to a support position at an angle oblique to said golf bag, a rubber band attached to said support legs, said rubber band being capable of pivoting said support legs from said stored position to said support position, a tension cable attached to said support legs, a support leg securing means having a secured and a released position, said securing means being connected to said tension cable, such that, when said securing means is in said secured position, said tension cable secures said support legs in opposition to said rubber band, and when said securing means is in said released position, said rubber band pivots said support legs to said support position.

7. A supporting device for a golf bag comprising:

a rigid retaining means encircling an upper portion of said golf bag, a plurality of support legs pivotably attached to said golf bag, said support legs having inwardly angled pins which are plugged into bores of a bearing web fastened within said retaining means, said support legs being capable of pivoting from a stored position in abutment of said golf bag to a support position at an angle oblique to said golf bag, at least one elastic element attached to said support legs, said elastic element being capable of pivoting said support legs from said stored position to said support position, a tension cable attached to said support legs, a support leg securing means having a secured and a released position, said securing means being connected to said tension cable, such that, when said securing means is set in said secured position, said tension cable secures said support legs in opposition to said elastic element, and when said securing means is in said release position, said elastic element pivots said support legs to said support position.

8. The device of claim 7, wherein said pins are angled obliquely with respect to the center line between said support legs.

9. The device of claim 7, wherein said pins form an angle of greater than 90° with respect to the longitudinal axis of said support legs.

10. The device of claim 7, wherein said tension cable is inserted into a groove located in said securing means and said support legs are removably attached to said retaining means.

* * * * *